US011821676B2

(12) United States Patent
Son et al.

(10) Patent No.: US 11,821,676 B2
(45) Date of Patent: Nov. 21, 2023

(54) REFRIGERATOR

(71) Applicant: SAMSUNG ELECTRONICS CO., LTD., Suwon-si (KR)

(72) Inventors: Jonghyun Son, Suwon-si (KR); Seangwon Lee, Suwon-si (KR); Sungjun Cho, Suwon-si (KR); Dongyeong Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 177 days.

(21) Appl. No.: 17/178,913

(22) Filed: Feb. 18, 2021

(65) Prior Publication Data

US 2021/0262722 A1 Aug. 26, 2021

(30) Foreign Application Priority Data

Feb. 20, 2020 (KR) ..... 10-2020-0021245

(51) Int. Cl.
*F25D 23/02* (2006.01)

(52) U.S. Cl.
CPC ..... *F25D 23/025* (2013.01); *F25D 23/028* (2013.01); *F25D 2323/024* (2013.01)

(58) Field of Classification Search
CPC ..... F25D 23/025; F25D 2323/023; F25D 23/028; F25D 23/02; F25D 2323/024; F25D 2323/021; F25D 11/02; F25D 2400/18
See application file for complete search history.

(56) References Cited

U.S. PATENT DOCUMENTS

| | | | | |
|---|---|---|---|---|
| 8,960,826 | B2 | 2/2015 | Choo et al. | |
| 9,170,045 | B2 * | 10/2015 | Oh | E05D 11/1078 |
| 9,175,901 | B2 | 11/2015 | Oh et al. | |
| 9,308,677 | B2 * | 4/2016 | Lee | F25D 23/028 |
| 9,441,872 | B2 | 9/2016 | Park et al. | |
| 9,810,475 | B2 * | 11/2017 | Kim | F25D 23/02 |
| 10,295,248 | B2 * | 5/2019 | Miller | F25D 23/04 |
| 10,451,334 | B2 * | 10/2019 | Xia | E05D 7/02 |
| 2008/0143227 | A1 * | 6/2008 | Kim | F25D 23/02 312/405 |

(Continued)

FOREIGN PATENT DOCUMENTS

| | | | |
|---|---|---|---|
| CN | 202734406 U | | 2/2013 |
| CN | 203396191 U | * | 1/2014 |

(Continued)

OTHER PUBLICATIONS

PCT International Search Report for International Application No. PCT/KR2021/001705 dated Jun. 3, 2021.

(Continued)

*Primary Examiner* — Hiwot E Tefera
(74) *Attorney, Agent, or Firm* — STAAS & HALSEY LLP

(57) ABSTRACT

Provided is a refrigerator including a main body including a storage chamber, a first door rotatably coupled to the main body and having an opening, and a second door rotatably coupled to the main body and the first door to open and close the opening, wherein the first door includes a first assembly formed with the opening, a second assembly provided below the first assembly, and a coupling frame arranged between the first assembly and the second assembly for the first assembly and the second assembly rotate as a unitary body.

19 Claims, 14 Drawing Sheets

(56) References Cited

U.S. PATENT DOCUMENTS

| | | | | |
|---|---|---|---|---|
| 2011/0089790 | A1* | 4/2011 | Lee | F25D 23/02 29/890.035 |
| 2013/0111941 | A1* | 5/2013 | Yu | F25D 23/028 222/173 |
| 2014/0132146 | A1* | 5/2014 | Kim | F25D 23/02 312/405.1 |
| 2014/0208657 | A1* | 7/2014 | Kim | F25D 23/02 49/460 |
| 2016/0061511 | A1* | 3/2016 | Park | F25D 23/025 312/405 |
| 2016/0146529 | A1* | 5/2016 | Choi | F25D 23/062 312/405.1 |
| 2017/0211874 | A1* | 7/2017 | Kim | F25D 27/005 |
| 2017/0370631 | A1* | 12/2017 | Kim | F25D 23/006 |
| 2018/0156535 | A1* | 6/2018 | Kim | G10L 21/0232 |
| 2018/0164031 | A1* | 6/2018 | Lee | A47F 3/0434 |
| 2018/0266750 | A1* | 9/2018 | Hurlebaus | F25D 23/087 |
| 2018/0372394 | A1* | 12/2018 | Kim | F25D 29/005 |

FOREIGN PATENT DOCUMENTS

| | | | | | |
|---|---|---|---|---|---|
| CN | 106839625 | A | * | 6/2017 | F25D 23/028 |
| CN | 106839625 | B | | 10/2019 | |
| KR | 10-0692223 | B1 | | 3/2007 | |
| KR | 10-1156286 | B1 | | 6/2012 | |
| KR | 10-1275987 | B1 | | 6/2013 | |
| KR | 10-1339925 | B1 | | 12/2013 | |
| KR | 10-2014-0008559 | A | | 1/2014 | |
| KR | 10-2014-0097799 | A | | 8/2014 | |
| KR | 10-1774070 | B1 | | 9/2017 | |
| KR | 10-2019-0023605 | A | | 3/2019 | |
| KR | 10-2019-0024487 | A | | 3/2019 | |
| KR | 10-1998569 | B1 | | 9/2019 | |
| KR | 10-2102642 | B1 | | 4/2020 | |

OTHER PUBLICATIONS

European Search Report dated Sep. 15, 2022, issued in European Application No. 21756425.1.

* cited by examiner

REFRIGERATOR

CROSS-REFERENCE TO RELATED APPLICATION

This application is based on and claims priority under 35 U.S.C. § 119 to Korean Patent Application No. 10-2020-0021245, filed on Feb. 20, 2020 in the Korean Intellectual Property Office, the disclosure of which is incorporated herein by reference.

BACKGROUND

1. Field

The disclosure relates to a refrigerator having an improved structure for a door

2. Description of the Related Art

In general, a refrigerator is a home appliance that includes a main body having a storage chamber and a cold air supply system for supplying cold air to the storage chamber to keep food fresh. The storage chamber includes a refrigerating chamber to keep food refrigerated at a temperature between about 0° C. and +5° C. and a freezing chamber to keep food frozen at a temperature between about −35° C. and 0° C.

The refrigerator may be classified into different types according to the storage chamber and a door thereof. A top mounted freezer (TMF)-type refrigerator is provided with a storage chamber that is divided into an upper side and a lower side by a horizontal partition while a freezing chamber is formed at the upper side and a refrigerating chamber is formed at the lower side, and a bottom mounted freezer (BMF)-type refrigerator is provided with a refrigerating chamber formed at the upper side and a freezing chamber formed at the lower side. In addition, a side by side (SBS)-type refrigerator is provided with a storage chamber that is divided into a left side and a right side by a vertical partition while a freezing chamber is formed at one side and a refrigerating chamber is formed at the other side, and a French door refrigerator (FDR)-type refrigerator is provided with a storage chamber that is divided into an upper side and a lower side by a horizontal partition while a refrigerating chamber is formed at the upper side and a freezing chamber is formed at the lower side, as the refrigerating chamber at the upper side is open/closed by a pair of doors.

The door of the refrigerator has a door frame forming the external appearance, and injection molded products may be coupled to the top and the bottom of the frame.

In general, the door frame may be formed of a single material, and the exterior of the door may include a steel plate or glass material. In addition, recently, a refrigerator is in the trend of having a double door including an inner door and an outer door mounted on the inner door.

SUMMARY

Therefore, it is an aspect of the disclosure to provide a refrigerator in which an upper portion and a lower portion of a refrigerator door having a double door are formed of different materials.

It is another aspect of the disclosure to provide a refrigerator having an improved assembly structure for a door that minimizes loss of raw material.

Additional aspects of the disclosure will be set forth in part in the description which follows and, in part, will be obvious from the description, or may be learned by practice of the disclosure.

According to an aspect of the disclosure, there is provided a refrigerator including: a main body including a storage chamber; a first door rotatably coupled to the main body and having an opening; and a second door rotatably coupled to the main body and the first door to open and close the opening, wherein the first door includes: a first assembly formed with the opening; a second assembly provided below the first assembly; and a coupling frame arranged between the first assembly and the second assembly.

The coupling frame may include a support portion extending along an inner surface of the first assembly to come in contact with a lower inner surface of the first assembly.

The first assembly may include a first frame bent to form a front exterior of the first assembly, and the coupling frame may include an insertion space provided below the support portion and allowing a lower end bent portion of the first frame to be inserted thereinto.

The second assembly may include: a second frame bent to form one side surface and a part of a front surface of the second assembly; a third frame bent to form an other side surface of the second assembly and the front surface protruding forward of the second frame; and a handle frame connected to the second frame and the third frame.

The support portion may form a first support portion, and the coupling frame may include: a second support portion provided in parallel with an inner surface of the second frame to come in contact with an upper inner surface of the second frame; a third support portion provided in parallel with an inner surface of the third frame to come in contact with an upper inner surface of the third frame, the third support portion protruding forward of the first support portion and the second support portion; and a handle support portion provided between the second support portion and the third support portion.

The coupling frame may include a cover seating portion extending from a lower side of the first support portion toward the third support portion and having at least one hook coupling groove.

The first door may include a cover configured to cover the cover seating portion and provided with at least one hook protruding downward to be inserted into the at least one hook coupling groove.

The coupling frame may include a reinforcing member receiving groove formed by a side surface of the coupling frame being recessed inward, the refrigerator further including a reinforcing member inserted into the reinforcing member receiving groove.

A first fastening member may be coupled to pass through the first assembly, the coupling frame, and the reinforcing member from an upper rear side of the reinforcing member, and a second fastening member may be coupled to pass through the second assembly, the coupling frame, and the reinforcing member from a lower rear side of the reinforcing member.

The coupling frame may include a plurality of coupling hooks formed on a rear surface thereof, and the first assembly and the second assembly may include at least one hook coupling hole provided to be fastened with the plurality of coupling hooks.

The refrigerator may further include: a hinge bracket coupled to the first assembly and the coupling frame; and a rotation shaft inserted into the hinge bracket and the coupling frame, wherein the second door may be coupled to the coupling frame to be rotated on the rotation shaft.

The first assembly, the second assembly, and the coupling frame may include an iron plate material.

The refrigerator may further include a door reinforcing member fixed to insides of the first assembly and the second assembly along edges of the first assembly and the second assembly.

The coupling frame may include: a receiving portion formed at one side of the coupling frame to receive the door reinforcing member; and an elastic portion formed at an other side of the coupling frame and including a material having elasticity to allow the door reinforcing member to be fitted to the coupling frame.

The receiving portion may be formed to extend in a direction from a rear side of the coupling frame to a front side of the coupling frame.

According to another aspect of the disclosure, there is provided a refrigerator including: a main body including a storage chamber; a first door rotatably coupled to the main body and having an opening; and a second door rotatably coupled to the main body and the first door to open and close the opening, wherein the first door includes: a first assembly formed with the opening; a second assembly provided at a lower side of the first assembly and including a plurality of chassis and glass; and a coupling frame arranged between the first assembly and the second assembly, the coupling frame including a coupling hook provided to be coupled to the plurality of chassis.

The second assembly may include: a second frame bent to form one side surface and a part of a front surface of the second assembly; a first chassis bent to form an other side surface of the second assembly and protrude forward of the second frame; and a second chassis connected to the second frame and bent to protrude forward of the second frame, wherein the glass may be seated between the first chassis and the second chassis to form the front surface of the second assembly that is protruded.

The second chassis may include a handle portion formed by the second chassis being recessed inward.

According to another aspect of the disclosure, there is provided a refrigerator including: a main body; an inner door rotatably coupled to the main body, the inner door including a first assembly formed with an opening and a second assembly provided to protrude forward of the first assembly; and an outer door rotatably coupled to the inner door to open and close the opening, wherein the inner door includes a coupling frame provided between the first assembly and the second assembly to come in contact with inner surfaces of the first assembly and the second assembly.

The refrigerator may further include a door reinforcing member seated along an edge of the inner door to reinforce strength of the inner door.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
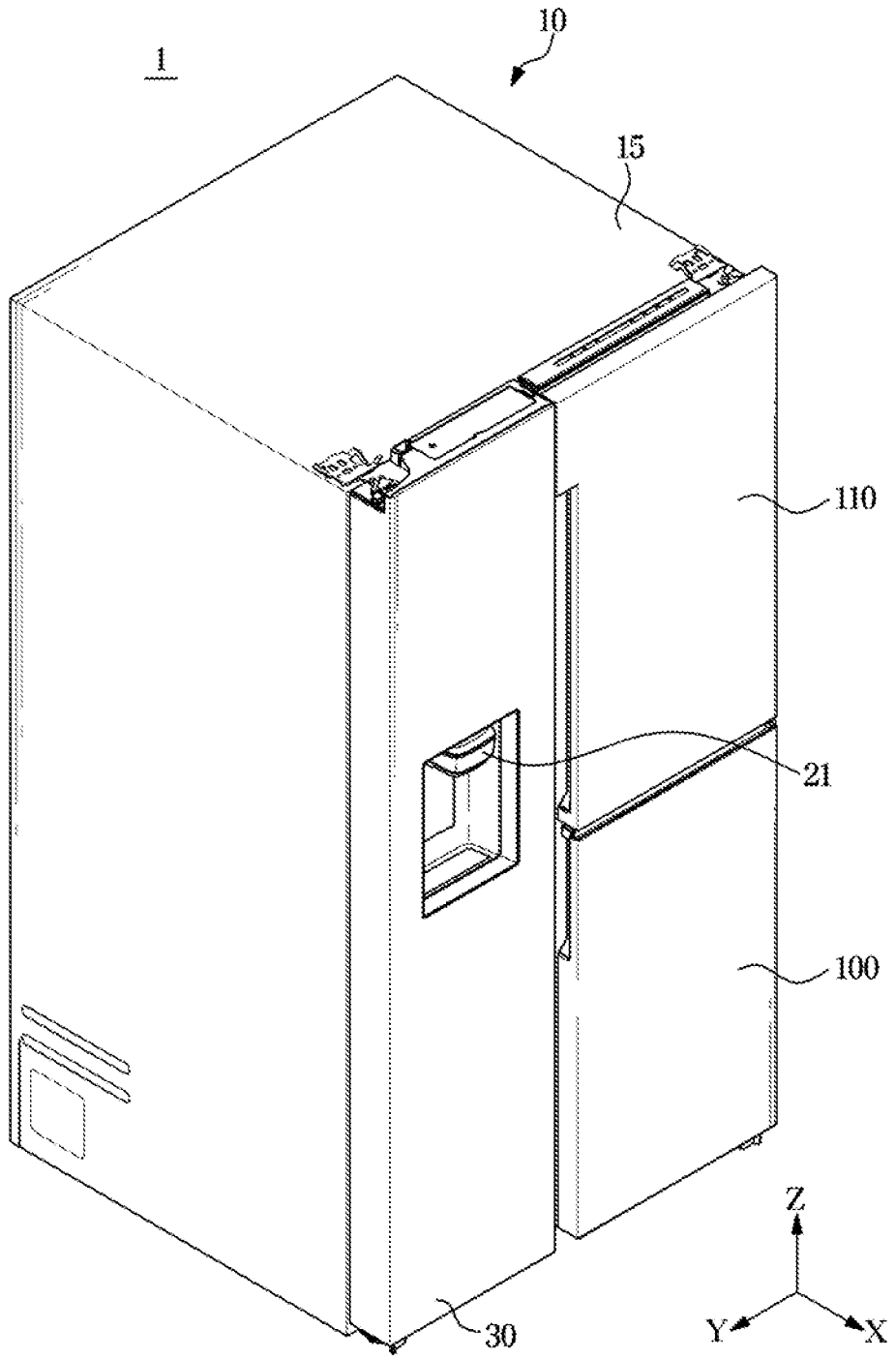
FIG. 1 is a perspective view illustrating a refrigerator according to an embodiment of the disclosure.

The embodiments set forth herein and illustrated in the configuration of the disclosure are only the most preferred embodiments and are not representative of the full technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Hereinafter, embodiments according to the disclosure will be described in detail with reference to the accompanying drawings.

Figure 2:
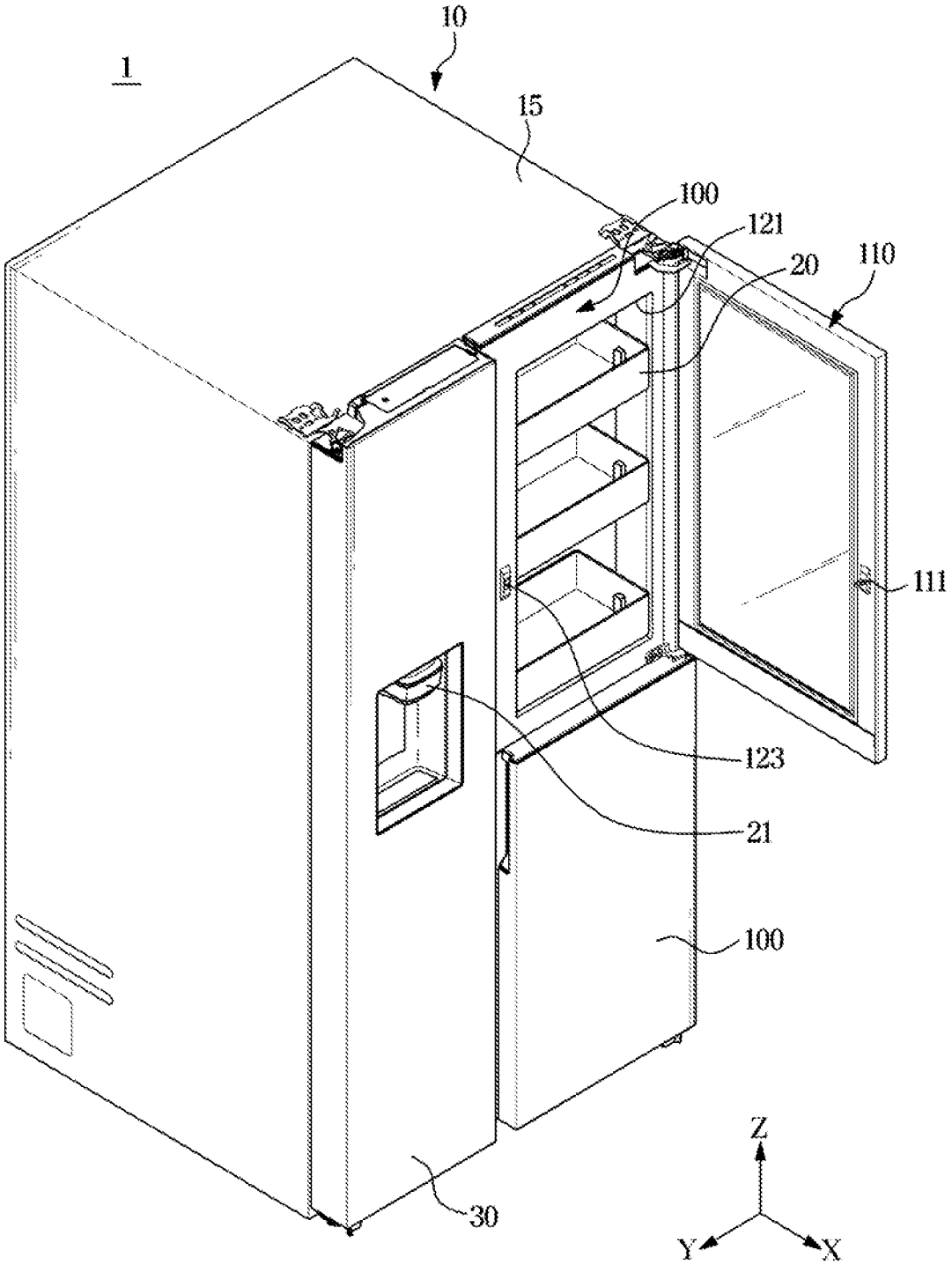
FIG. 2 is a perspective view illustrating the refrigerator according to the embodiment of the disclosure, with a second door opened.
Figure 3:
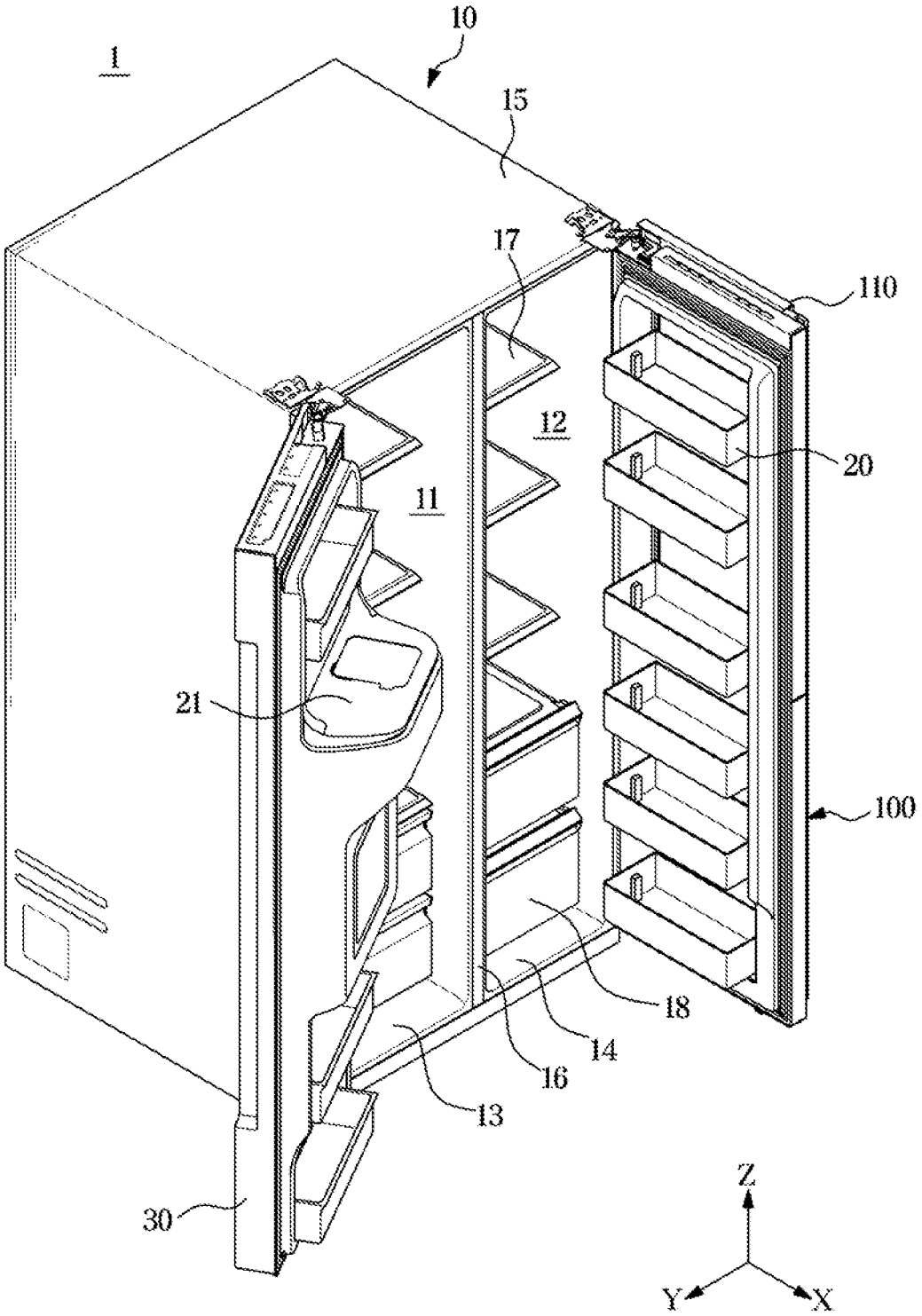
FIG. 3 is a perspective view illustrating the refrigerator according to the embodiment of the disclosure, with both a freezing chamber door and a first door opened.

FIG. 1 is a perspective view illustrating a refrigerator according to an embodiment of the disclosure. FIG. 2 is a perspective view illustrating the refrigerator according to the embodiment of the disclosure, with a second door opened. FIG. 3 is a perspective view illustrating the refrigerator according to the embodiment of the disclosure, with both a freezing chamber door and a first door opened.

Referring to FIGS. 1 to 3, the refrigerator 1 according to the embodiment of the disclosure may include a main body 10, a plurality of storage chambers 11 and 12 formed inside the main body 10, and a plurality of doors provided to open and close the plurality of storage chambers 11 and 12.

The main body 10 includes a plurality of inner case 13 and 14 and an outer case 15 disposed outside the plurality of inner cases 13 and 14 to form the external appearance of the refrigerator 1. An insulating material (not shown) may be foamed and filled between the plurality of inner cases 13 and 14 and the outer case 15 to prevent cold air from leaking to the outside.

The plurality of inner cases 13 and 14 may include a first inner case 13 and a second inner case 14 adjacent to each other in a left-to-right direction Y of the refrigerator 1. The first inner case 13 may be arranged on the left side of a partition wall 16 in the left-to-right direction Y of the refrigerator 1 and the second inner case 14 may be arranged on the right side of the partition wall 16 in the left-to-right direction Y of the refrigerator 1. An insulating material (not shown) may be foamed and filled between the first inner case 13 and the second inner case 14 to prevent heat exchange between the freezing chamber 11 and the refrigerating chamber 12.

The plurality of storage chambers 11 and 12 may include the freezing chamber 11 provided inside the main body 10. The plurality of storage chambers 11 and 12 may include the freezing chamber 11 provided inside the first inner case 13.

The plurality of storage chambers 11 and 12 may further include the refrigerating chamber 12 provided inside the main body 10 so as to be adjacent to the freezing chamber 11 in the left-to-right direction Y direction of the refrigerator 1. In detail, the plurality of storage chambers 11 and 12 may further include the refrigerating chamber 12 provided inside the second inner case 14.

The plurality of storage chambers 11 and 12 may each include an open front. Inside the plurality of storage chambers 11 and 12, a plurality of shelves 17 and/or a plurality of storage boxes 18 may be provided to store food and the like.

The storage box 18 may be provided to accommodate and store food therein. The storage box 18 may be located in the refrigerating chamber 12. The storage box 18 may be withdrawn from or inserted into the refrigerating chamber 12. The storage box 18 may be provided to be movable in a front-to-rear direction X of the refrigerator 1. The storage box 18 may be slidably moved with respect to the refrigerating chamber 12.

The plurality of doors may be rotatably installed on the main body 10 to open and close the open fronts of the plurality of storage chambers 11 and 12. The plurality of doors may include a freezing chamber door for the freezing chamber 11 rotatably installed on the main body 10 to open and close the freezing chamber 11, and a refrigerating chamber door for the refrigerating chamber 12 rotatably installed on the main body 10 to open and close the refrigerating chamber 12.

The refrigerating chamber door may include a first door 100 and a second door 110. The first door 100 may be provided as an inner door, and the second door 110 may be provided as an outer door.

The first door 100 may be formed with an opening 121 communicating with the refrigerating chamber 12. The second door 110 may be rotatably coupled to the main body 10 and the first door 100 to open and close the opening 121 of the first door 100.

The first door 100 may be provided at a rear side thereof with a plurality of door guards 20. The user may open the second door 110 to access the door guard 20 provided at the rear side of the first door 100 or the refrigerating chamber 12.

A dispenser 21 may be provided in at least one of the plurality of doors for a user to extract water or ice from the outside. In detail, according to the embodiment shown in FIG. 1, the dispenser 21 may be provided in the freezing chamber door.

The refrigerator 1 may further include a cold air supply device provided to supply cold air to the plurality of storage chambers 11 and 12. The cold air supply device may include a compressor, a condenser, an expansion valve, and an evaporator. The compressor for compressing a refrigerant and the condenser for condensing the compressed refrigerant may be installed in a machine room provided at a rear lower side of the plurality of storage chambers 11 and 12.

Figure 4:
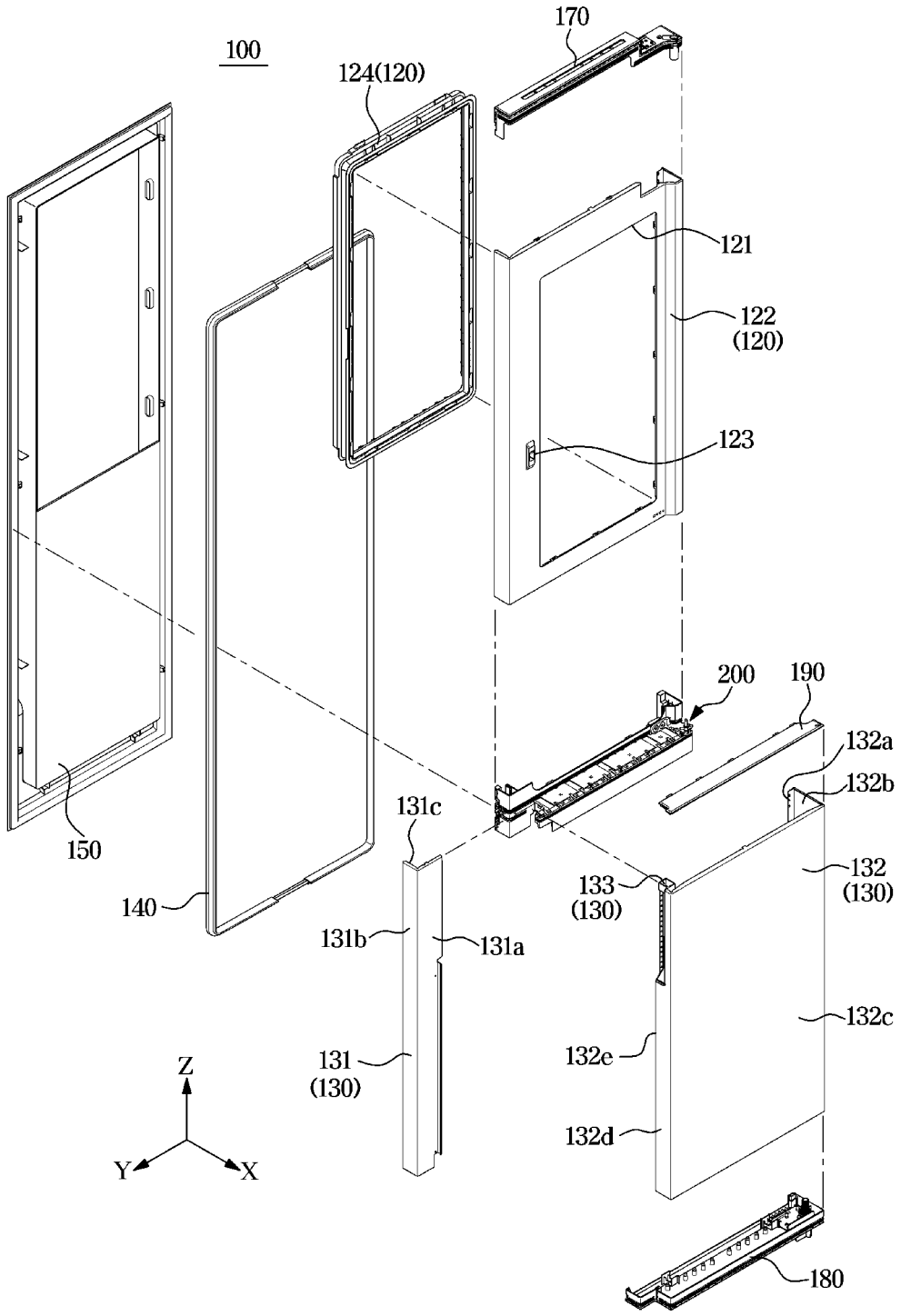
FIG. 4 is an exploded perspective view illustrating the first door of the refrigerator according to the embodiment of the disclosure.

FIG. 4 is an exploded perspective view illustrating the first door of the refrigerator according to the embodiment of the disclosure.

Referring to FIG. 4, the first door 100 may include a first assembly 120, a second assembly 130, and a coupling frame 200.

The first assembly 120 may include a first frame 122 bent to form a front exterior of the first assembly 120 and a door trim 124.

The first frame 122 may be formed of a steel plate material. The first frame 122 may be provided in an approximately box shape with one surface open by bending a steel plate. In other words, the first frame 122 may be bent rearward to form an approximately box shape. However, the shape of the first frame 122 is not limited thereto.

The first frame 122 is provided at a front central portion thereof with the opening 121. The first frame 122 may have an upper end bent portion, a lower end bent portion, and a pair of side bent portions when viewed from the front of the first frame 122.

The door trim 124 may be arranged behind the first frame 122 and may be coupled to the first frame 122. The door trim 124 may be provided in an approximately quadrangular ring shape. However, the shape of the door trim 124 is not limited thereto.

The door trim 124 may be provided in a size corresponding to the opening 121 of the first frame 122 and may be coupled to the first frame 122 in a groove-protrusion coupling scheme. However, the coupling method of the door trim 124 and the first frame 122 is not limited thereto. The door trim 124 may be provided to prevent leakage of a foaming liquid to the outside when a foaming liquid is foamed inside the first door 100.

The first frame 122 may include a door latch 123 on a front thereof. The door latch 123 may be mounted at an inner side of the front of the first frame 122 and exposed to the outside. The second door 110 may include a protrusion 111 for coupling to the door latch 123. The door latch 123 is provided to determine whether to allow rotation of the second door 110.

The first assembly 120 may be provided as an upper assembly.

The second assembly 130 may include a second frame 131, a third frame 132, and a handle frame 133.

The second frame 131 may be provided to be bent to form one side surface and a part of a front surface of the second assembly 130. The second frame 131 may include a front portion 131*a*, a side portion 131*b*, and a rear portion 131*c*. In addition, the second frame 131 may include an upper side bent portion and a lower side bent portion (not shown). Each portion may be provided to be approximately perpendicular to each other.

The third frame 132 may be provided to be bent to form the other side surface of the second assembly 130 and the front surface protruding forward of the second frame 131. The third frame 132 may include a front portion 132*c*, a pair of side portions 132*b* and 132*d*, and a pair of rear portions 132*a* and 132*e*. In addition, the third frame 132 may include an upper side bent portion and a lower side bent portion (not shown).

The handle frame 133 may be arranged between the second frame 131 and the third frame 132 to be connected to the second frame 131 and the third frame 132. The handle frame 133 may be hooked to the second frame 131 and the third frame 132. In addition, the handle frame 133 may be arranged to partially overlap the third frame 132 and hooked to the third frame 132. A handle support portion 240 may be arranged to interfere with the second frame 131 and coupled to the second frame 131.

Accordingly, the second frame 131, the handle frame 133, and the third frame 132 may be connected to each other. In other words, the handle frame 133 may connect the second frame 131 to the third frame 132. The handle frame 133 may be formed by a side portion of the first door 100 being recessed inwardly so that the user may grip the handle frame 133 by putting a hand into the handle frame 133 from the outside.

The second frame 131, the third frame 132, and the handle frame 133 may all be formed of a steel plate material. The second assembly 130 may be provided below the first assembly 120.

That is, the second assembly 130 may be provided as a lower assembly.

The first door 100 includes the coupling frame 200 and a cover 190 arranged between the first assembly 120 and the second assembly 130 so that the first assembly 120 and the second assembly 130 rotate together with each other as a unitary body.

The cover 190 may be coupled to an upper portion of the coupling frame 200 to cover an exposed portion of the coupling frame 200. The coupling relationship between the first assembly 120, the second assembly 130, and the coupling frame 200, and detailed coupling relationship between the coupling frame 200 and the cover 190 will be described below.

The first door 100 may include a door reinforcing member 140 arranged behind the first assembly 120, the second assembly 130, and the coupling frame 200.

The door reinforcing member 140 is provided to reinforce the coupling between the first assembly 120, the second assembly 130, and the coupling frame 200. The door reinforcing member 140 may be inserted into and fixed to an inner side of an edge portion of the first door 100. Details of a seating structure of the door reinforcing member 140 will be described below.

The first door 100 may include a rear frame 150, an upper cap door 170, and a lower cap door 180.

The rear frame 150 may form a rear surface of the first door 100. The rear frame 150 may include the opening 121. The plurality of door guards 20 may be mounted on the rear frame 150. The upper cap door 170 may be coupled to an upper portion of the first frame 122, and the lower cap door 180 may be coupled to lower portions of the second frame 131 and the third frame 132. The upper cap door 170 may form an upper surface of the first door 100, and the lower cap door 180 may form a lower surface of the first door 100. With such a configuration, the first door 100 may form a space for filling the foaming liquid in a region except for the opening 121.

Figure 5:
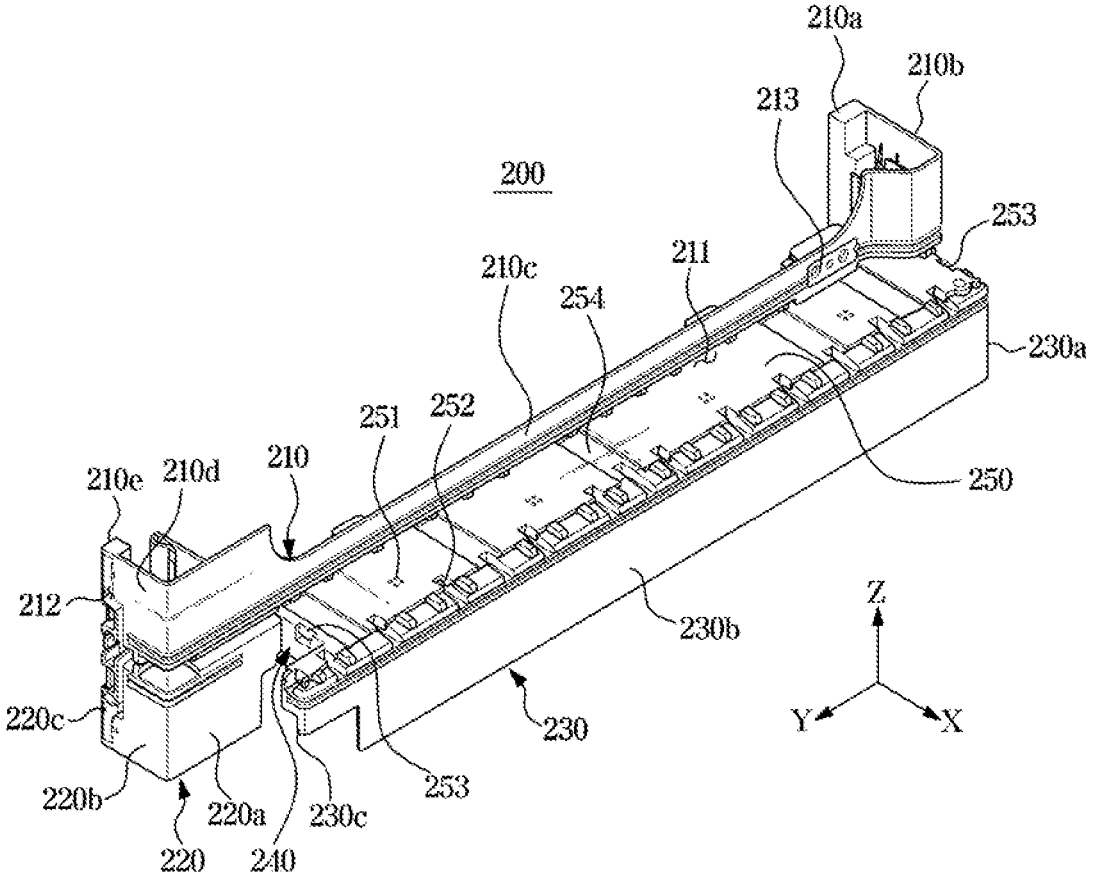
FIG. 5 is a perspective view illustrating a coupling frame shown in FIG. 4.
Figure 6:
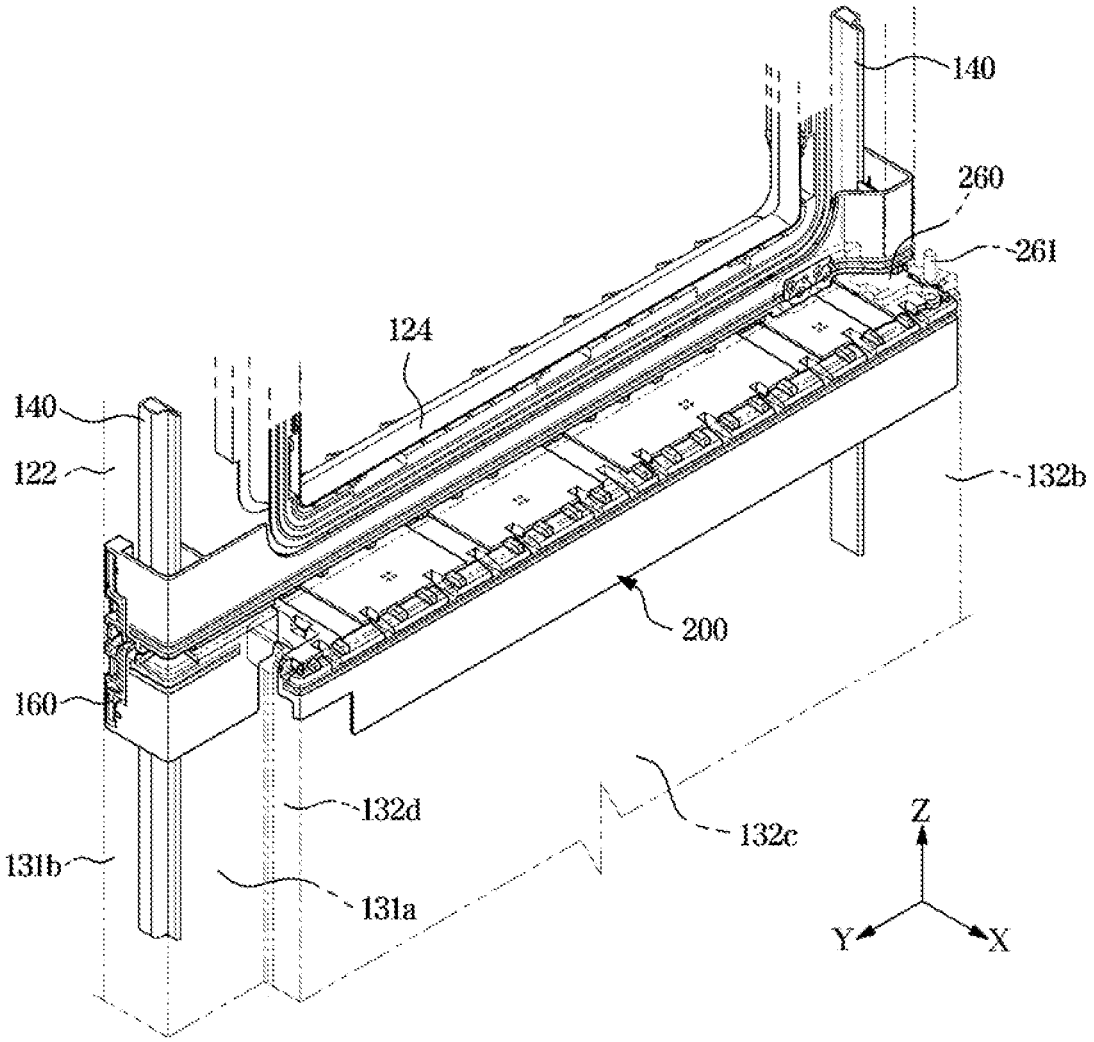
FIG. 6 is a view illustrating the first door in a coupled state.
Figure 7:
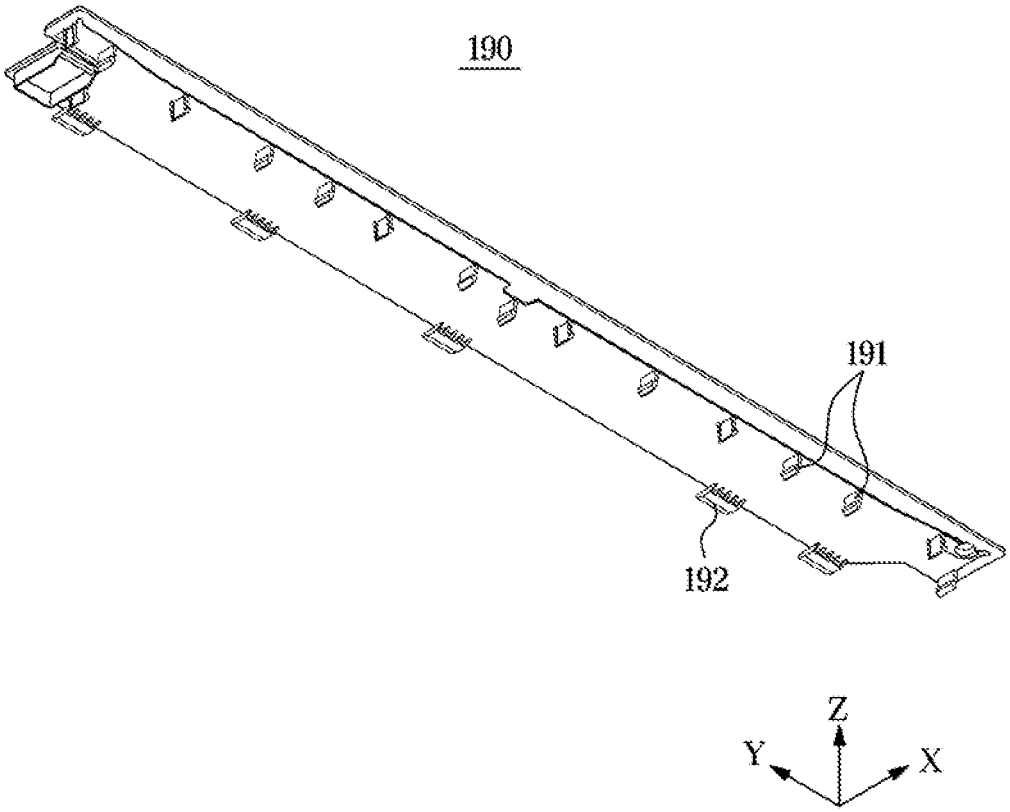
FIG. 7 is a bottom perspective view illustrating a cover shown in FIG. 4.

FIG. 5 is a perspective view illustrating the coupling frame shown in FIG. 4. FIG. 6 is a view illustrating the first door in a coupled state. FIG. 7 is a bottom perspective view illustrating the cover 190 shown in FIG. 4.

Referring to FIG. 5, the coupling frame 200 may include a first support portion 210, a second support portion 220, a third support portion 230, and a handle support portion 240.

The coupling frame 200 may include the first support portion 210 extending along the inner surface of the first assembly 120 so as to come in contact with the lower inner surface of the first assembly 120. The first support portion 210 may be provided to extend upward. The first support portion 210 may be provided in parallel with the inner surface of the first assembly 120.

In detail, the first support portion 210 may be provided to support the first assembly 120. The first support portion 210 may include a front support portion 210*c*, a pair of side support portions 210*b* and 210*d*, and a pair of rear support portions 210*a* and 210*e*. Each of the pair of side support portions 210*b* and 210*d* of the first support portion 210 may be formed with a reinforcing member receiving groove 212, which will be described below. The first support portion 210 may be provided at an upper portion of the coupling frame 200 with respect to an insertion space 211.

The coupling frame 200 may include the insertion space 211 provided below the first support portion 210 and into which the lower end bent portion of the first frame 122 is inserted.

The first support portion 210 may include a hinge coupling portion 213. In detail, the front support portion 210*c* of the first support portion 210 may be provided with the hinge coupling portion 213. A hinge bracket 260 may be coupled to the hinge coupling portion 213 by a fastening member 99.

The coupling frame 200 may include the second support portion 220 provided in parallel with the inner surface of the second frame 131 so as to come in contact with the upper inner surface of the second frame 131. In detail, the second support portion 220 may be provided to extend downward from one side of the first support portion 210.

The second support portion 220 may include a front support portion 220*a*, a side support portion 220*b*, and a rear support portion 220*c*. The side support portion 220*b* of the second support portion 220 may be formed with the reinforcing member receiving groove 212 to be described below.

The coupling frame 200 may include the third support portion 230 provided in parallel with the inner surface of the third frame 132 so as to come in contact with the upper inner surface of the third frame 132.

The third support portion 230 may include a front support portion 230*b*, a pair of side support portions 230*a* and 230*c*, and a rear support portion 230*z*. One of the pair of side support portions 230*a* and 230*c* of the third support portion 230 that joins the first support portion 210 may be formed with the reinforcing member receiving groove 212, which will be described below.

The coupling frame 200 may include the handle support portion 240 provided between the second support portion 220 and the third support portion 230. The handle support portion 240 may be a portion on which the handle frame 133 is seated and may be hook-coupled to the handle frame 133.

The first support portion 210, the second support portion 220, and the third support portion 230 of the coupling frame 200 may be provided substantially perpendicular to the ground.

The side support portion 210*d* of the first support portion 210 of the coupling frame 200 and the side support portion 220*b* of the second support portion 220 of the coupling frame 200 may form one side surface of the coupling frame 200. In addition, the side support portion 210*b* of the first support portion 210 of the coupling frame 200 and the side support portion 230*a* of the third support portion 230 of the coupling frame 200 may form the other side surface of the coupling frame 200.

The refrigerator 1 may include a reinforcing member 160. The reinforcing member 160 may be inserted into the reinforcing member receiving groove 212 provided at both side surfaces of the coupling frame 200. The reinforcing member receiving grooves 212 may be formed by the both side surfaces of the coupling frame 200 being recessed inwardly.

In detail, the reinforcing member receiving groove 212 on one side surface of the coupling frame 200 may be formed in the side support portion 210*d* of the first support portion 210 and the side support portion 220*b* of the second support portion 220. The reinforcing member receiving groove 212 on the other side surface of the coupling frame 200 may be formed in the side support portion 210*b* of the first support portion 210 and the side support portion 230*a* of the third support portion 230. Detailed coupling relationship of the first door 100 using the reinforcing member 160 will be described below.

Referring to FIGS. 5 and 7, the first door 100 may include the cover 190, and the coupling frame 200 may include a cover seating portion 250 that extends from the lower side of the first support portion 210 toward the third support portion 230.

The cover seating portion 250 may include a plurality of air holes 251. Gas generated when the foaming liquid is filled in the door may be discharged through the air hole 251. In addition, the cover 190 covering the cover seating portion 250 may be bonded by the foaming liquid flowing through the air hole 251.

The cover (190 in FIG. 7) may include at least one hook 191. The at least one hook 191 may be formed to protrude downward from the bottom surface of the cover 190.

The cover 190 may include at least one protrusion 192. The at least one protrusion 192 may be formed to extend toward the coupling frame 200 to be inserted into the coupling frame 200. In the embodiment shown in FIGS. 5 to 7, five protrusions 192 are illustrated. However, the number of protrusions 192 may not be limited thereto.

The cover seating portion 250 includes at least one hook coupling groove 252. The at least one hook 191 of the cover 190 may be inserted into the at least one hook coupling groove 252 to enable hook-coupling. In addition, the cover seating portion 250 may include at least one protrusion receiving groove 254. The at least one protrusion 192 may be received in the at least one protrusion receiving groove 254.

In addition, the cover seating portion 250 may include hook coupling portions 253 provided on both sides thereof. Hooks 191 provided on both sides of the cover 190 are coupled to the hook coupling portions 253 so that the coupling between the cover 190 and the cover seating portion 250 may be secured.

The cover seating portion 250 of the coupling frame 200 may be exposed to the outside. The first support portion 210, the second support portion 220, the third support portion 230, and the handle support portion 240 of the coupling frame 200 may be provided to be covered by the first assembly 120 and the second assembly 130. However, the cover seating portion 250 may be exposed to the outside due to a shape of the third support portion 230 and the third frame 132 that protrudes forward. In order to cover the cover seating portion 250 to increase the aesthetic sense of the exterior, the cover 190 may be coupled and bonded to the cover seating portion 250.

Referring to FIGS. 5 and 6, a coupling relationship between the coupling frame 200, the first assembly 120, and the second assembly 130 may be illustrated. The first support portion 210 of the coupling frame 200 may support the lower inner side of the first frame 122. The second support portion 220 of the coupling frame 200 may support the upper inner side of the second frame 131, and the third support portion 230 of the coupling frame 200 may support the upper inner side of the third frame 132.

The reinforcing member 160 may be inserted into the side surface of the coupling frame 200. The hinge bracket 260 may be coupled to the hinge coupling portion 213 of the coupling frame 200. The hinge bracket 260 may be fastened to the first frame 122 and the coupling frame 200. A rotation shaft 261 may be inserted into the hinge bracket 260. The rotation shaft 261 may also be inserted into the coupling frame 200. The second door 110 may be coupled to the coupling frame 200 to be rotatable about the rotation shaft 261. Accordingly, the coupling frame 200 may be provided to be coupled to both the first door 100 and the second door 110.

Figure 8:
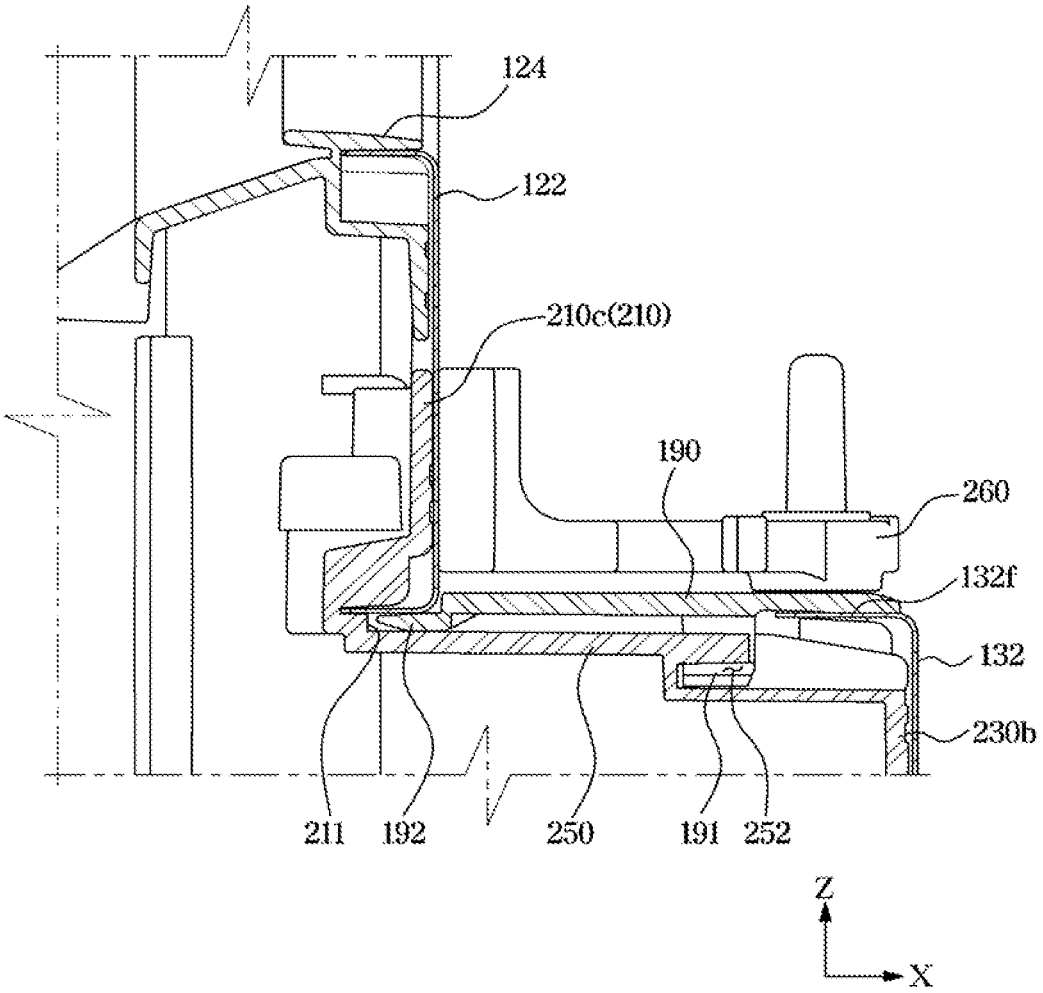
FIG. 8 is a cross-sectional view taken along an upper-to-lower side direction Z of the first door of the refrigerator according to the embodiment of the disclosure.

FIG. 8 is a cross-sectional view taken along an upper-to-lower side direction Z of the first door of the refrigerator according to the embodiment of the disclosure.

An arrangement relation between the first frame 122, the third frame 132, and the cover 190 will be described with reference to FIG. 8. The first frame 122 may include a bent portion provided at a lower side thereof.

Among the bent portions provided at the lower side of the first frame 122, a lower bent portion may be inserted between the front support portion of the first support portion 210 of the coupling frame 200 and the cover seating portion 250. Although not shown in the drawing, the lower bent portion may be hook-coupled to the coupling frame 200.

Among the bent portions provided at the lower side of the first frame 122, an upper bent portion may be inserted into the door trim 124 disposed on the upper side of the coupling frame 200.

The upper side bent portion of the third frame 132 may be arranged between the cover 190 and the cover seating portion 250 to be inserted inward With such an assembly structure, the coupling force between the components of the first door 100 may be improved.

Figure 9:
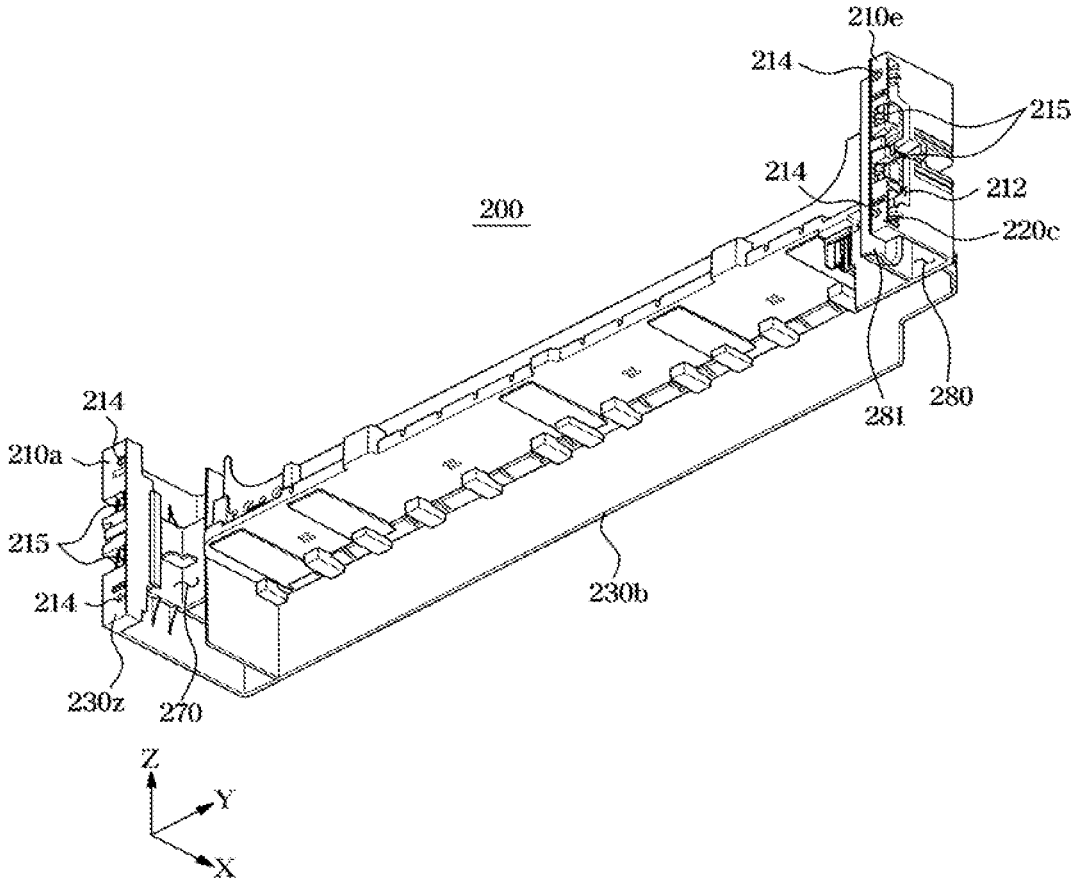
FIG. 9 is a perspective view illustrating a rear surface of the coupling frame according to the embodiment of the disclosure.
Figure 10:
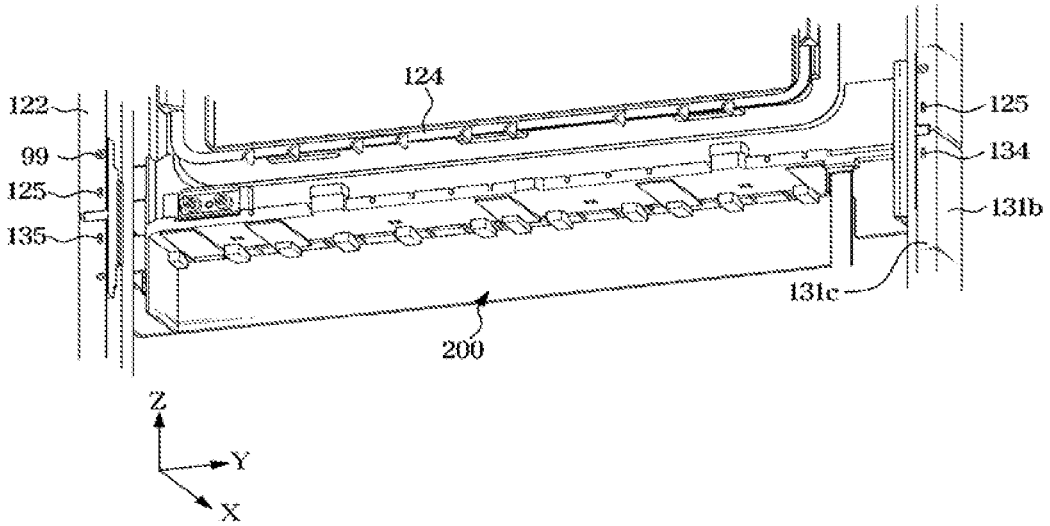
FIG. 10 is a rear view illustrating the first door in a coupled state according to the embodiment of the disclosure.

FIG. 9 is a perspective view illustrating a rear surface of the coupling frame according to the embodiment of the disclosure. FIG. 10 is a rear view illustrating the first door in a coupled state according to the embodiment of the disclosure.

Referring to FIGS. 9 and 10, the rear support portion 210*e* at the one side of the first support portion 210 and the rear support portion 220*c* of the second support portion 220 may form a rear surface of the one side of the coupling frame 200, and the rear support portion 210*a* at the other side of the first support portion 210 and the rear support portion 230*a* of the third support portion 230 may form a rear surface of the other side of the coupling frame 200.

The coupling frame 200 may include a plurality of coupling hooks 215 on the rear surface thereof. The first assembly 120 and the second assembly 130 may include a plurality of hook coupling holes 125, 134, and 135 provided to be fastened with the plurality of coupling hooks 215. With such a configuration, the positions of the coupling frame 200, the first assembly 120, and the second assembly 130 may be fixed without being coupled using the fastening member 99.

The coupling frame 200 may include a plurality of fastening member coupling holes 214 on the rear surface thereof. The reinforcing member receiving grooves 212 are formed on both side surfaces of the coupling frame 200, and the reinforcing member 160 may be inserted into the reinforcing member receiving groove 212.

The fastening member 99 may be coupled to pass through the first assembly 120, the coupling frame 200, and the reinforcing member 160 from the upper rear side of the reinforcing member 160. In addition, the fastening member 99 may be coupled to pass through the second assembly 130, the coupling frame 200, and the reinforcing member 160 from the lower rear side of the reinforcing member 160. In detail, the fastening member 99 may pass through the first frame 122 of the first assembly 120 and the third frame 132 of the second assembly 130. The fastening member 99 may be coupled by passing through the fastening member coupling hole 214 formed in the coupling frame 200.

Since the reinforcing member 160 is inserted across an upper portion and a lower portion of the side surface of the coupling frame 200, the fastening members 99 may be coupled to both the upper side and the lower side of the reinforcing member 160.

However, the disclosure is not limited thereto, and the fastening member 99 may be coupled to only one side of the reinforcing member 160.

With such a configuration, the coupling between parts of the first door 100 that are separately formed as an upper portion and a lower portion may be strengthened. The overall strength of the first door 100 may be increased through insertion of the reinforcing member 160 and coupling of the fastening member 99. The fastening member 99 may be provided with a screw.

Figure 11:
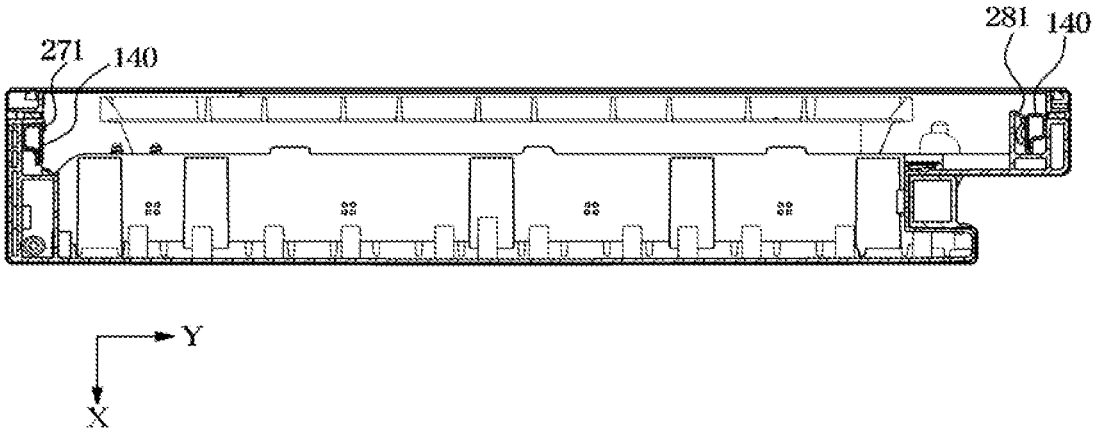
FIG. 11 is a cross-sectional view taken along a left-to-right direction Y of the first door of the refrigerator according to the embodiment of the disclosure.

FIG. 11 is a cross-sectional view taken along a left-to-right direction Y of the first door of the refrigerator according to the embodiment of the disclosure.

Referring to FIGS. 9 and 11, the refrigerator 1 may include the door reinforcing member 140 fixed to the insides of the first assembly 120 and the second assembly 130 along the edges of the first assembly 120 and the second assembly 130. In detail, the door reinforcing member 140 may be fixed by the coupling frame 200.

The coupling frame 200 may include a receiving portion 271 and an elastic portion 281. The receiving part 271 may be formed on one side of the coupling frame 200 to receive the door reinforcing member 140. The elastic portion 281 may be formed on the other side of the coupling frame 200 and including a material having elasticity so that the door reinforcing member 140 is fitted to the coupling frame 200.

The receiving portion 271 of the coupling frame 200 may be formed to extend in a direction from a rear side of the coupling frame 20 to a front side of the coupling frame 200. In detail, the receiving portion 271 may be formed to extend forward from the rear support portion of the first support portion 210 of the coupling frame 200 and the rear support portion of the third support portion 230 of the coupling frame 200. As the receiving portion 271 is formed, a first receiving space 270 for receiving the door reinforcing member 140 may be provided at the one side of the coupling frame 200.

The elastic portion 281 of the coupling frame 200 may be formed to extend rearward from the front support portion of the second support portion 220 of the coupling frame 200. As the elastic portion 281 is formed, a second receiving space 280 for receiving the door reinforcing member 140 may be provided at the other side of the coupling frame 200.

The elastic portion 281 may be provided to have elasticity, and may provide elastic force against a direction of the door reinforcing member 140 being pressed. With such a configuration, the door reinforcing member 140 may be fitted to the coupling frame 200.

The door reinforcing member 140 may be fixed by the coupling frame 200 before the foaming liquid is filled inside the door. As the foaming liquid is filled inside the door, the door reinforcing member 140 may be firmly coupled to the inside of the door. By using the door reinforcing member 140, the overall strength of the first door 100 provided as a combination of separate parts may be reinforced.

The parts of the first door 100 may be coupled to each other as a unitary body by the coupling frame 200.

When frames forming the external appearance of the first door 100 are formed of a single material, the material needs to be cut to provide a space for seating the second door 110 provided to open and close only a portion of the first door 100. However, in this case, loss of raw material may increase and the material cost may increase. According to the disclosure, the parts are coupled to each other based on the coupling frame 200, so that the loss of raw materials may be reduced, and the material cost for product production may also be reduced.

In addition, as the door is formed of different materials, the aesthetics may be enhanced.

Figure 12:
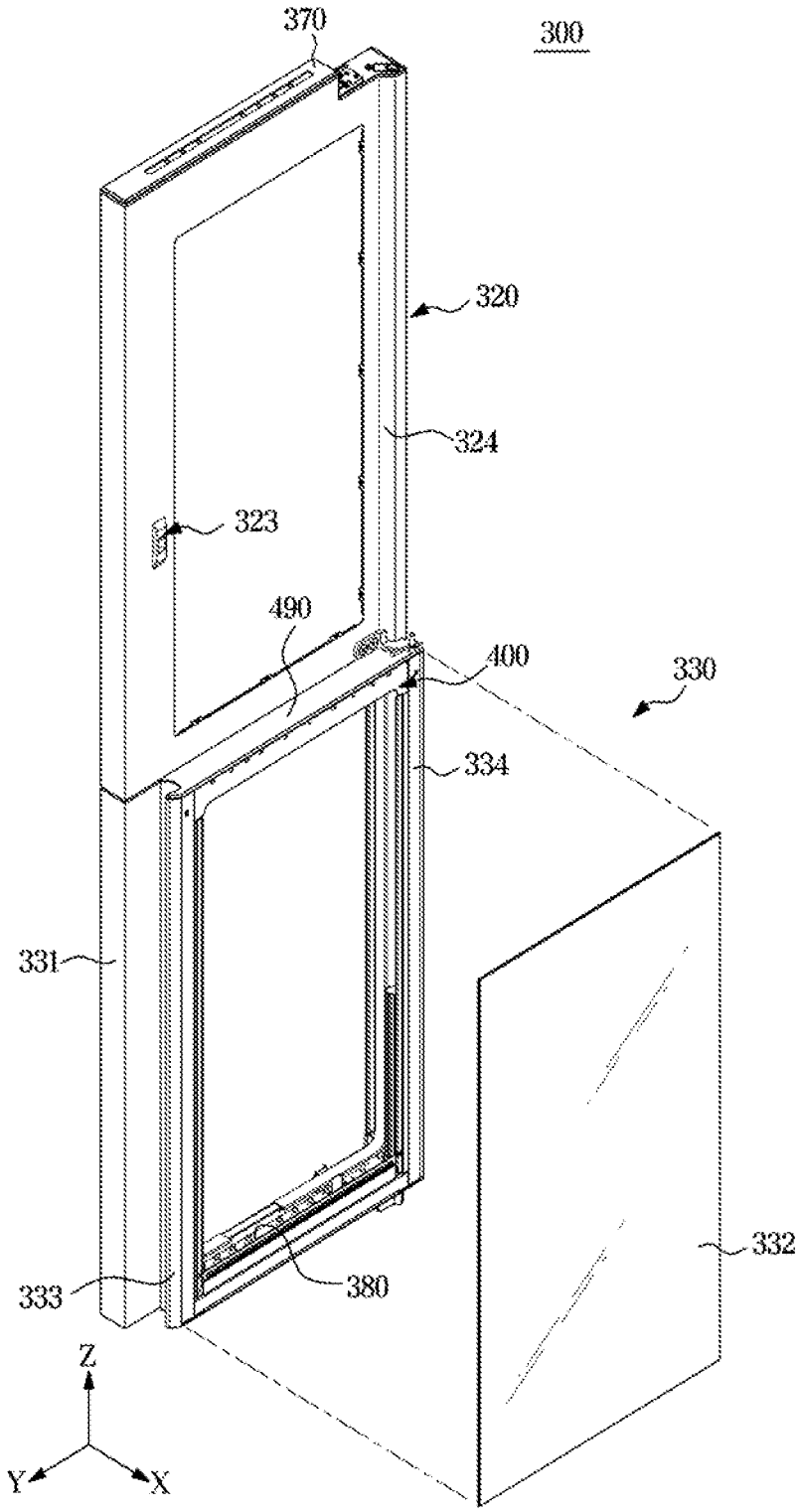
FIG. 12 is a view illustrating a first door of a refrigerator according to another embodiment of the disclosure.
Figure 13:
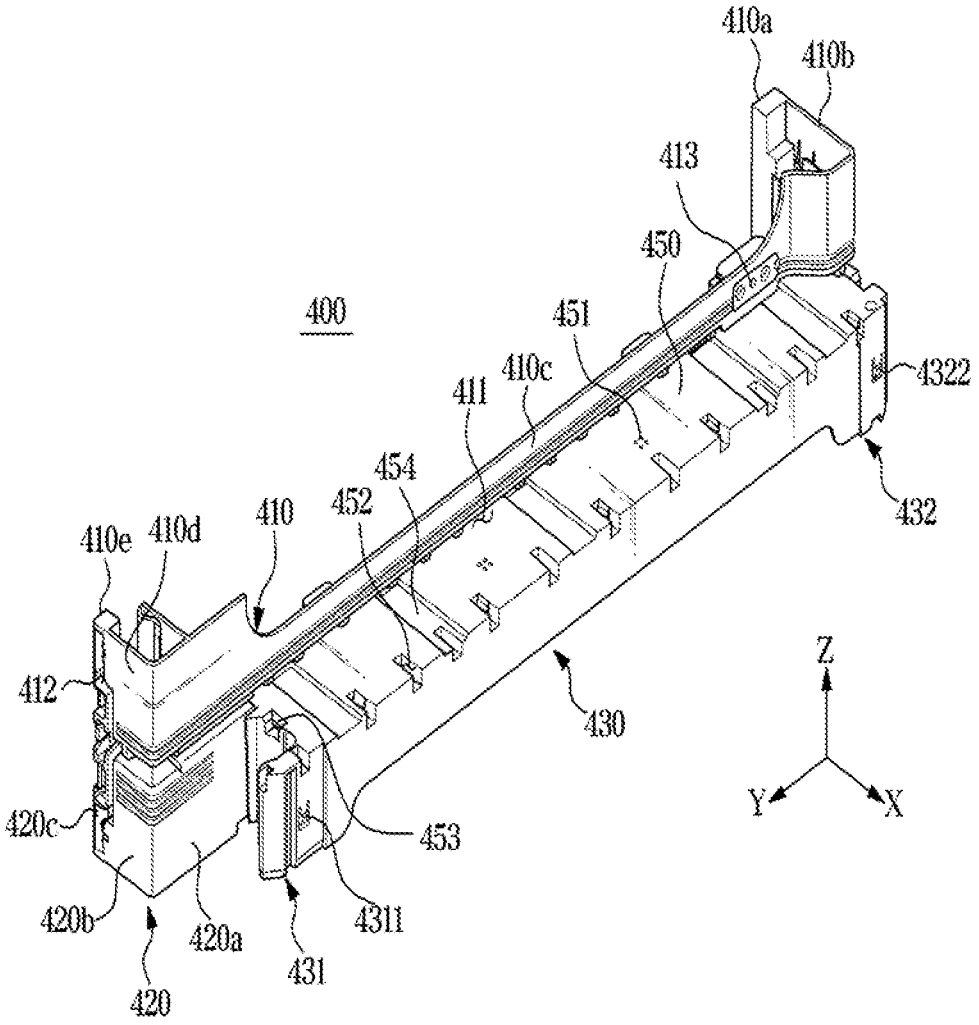
FIG. 13 is a perspective view illustrating a coupling frame of the refrigerator according to the another embodiment of the disclosure.
Figure 14:
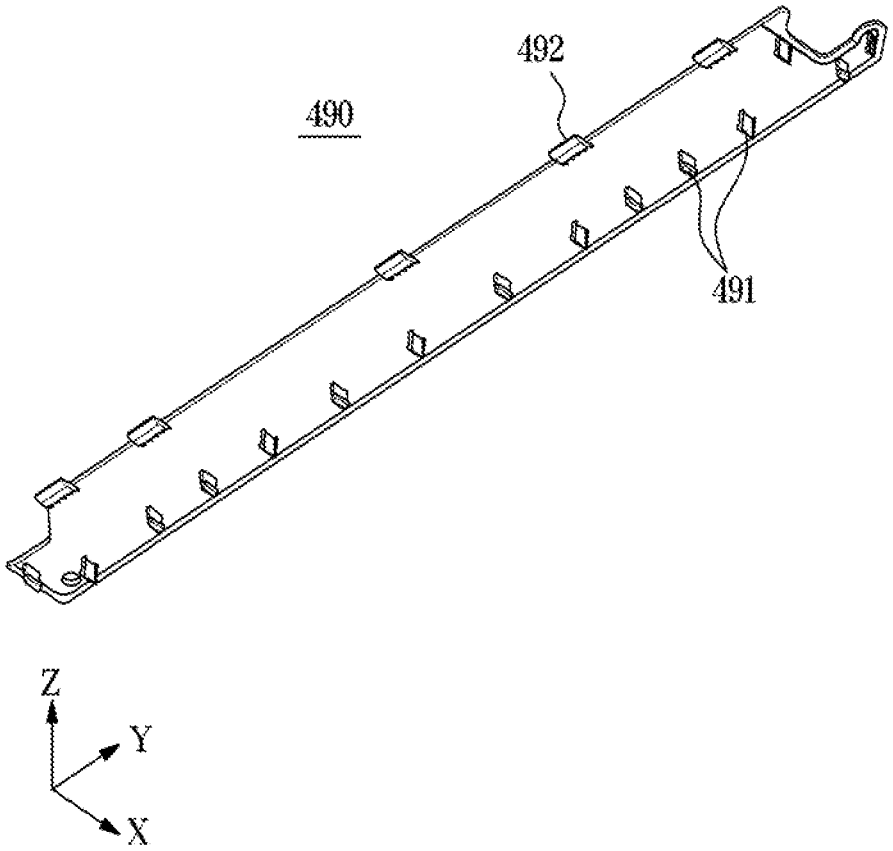
FIG. 14 is a bottom perspective view illustrating a cover of the refrigerator according to the another embodiment of the disclosure.

FIG. 12 is a view illustrating a first door of a refrigerator according to another embodiment of the disclosure. FIG. 13 is a perspective view illustrating a coupling frame of the refrigerator according to the another embodiment of the disclosure. FIG. 14 is a bottom perspective view illustrating a cover of the refrigerator according to the another embodiment of the disclosure.

Referring to FIG. 12, unlike the first door 100 of the refrigerator according to the above described embodiment, a first door 300 of a refrigerator according to another embodiment of the disclosure includes a second assembly that is partially formed of glass. Parts not described in FIGS. 12 to 14 may be considered identical to those of the first door 100 of the refrigerator according to the above described embodiment.

Accordingly, the following description of FIGS. 12 to 14 will be made on some features that are different from those of the first door 100 of the refrigerator according to the above embodiment of the disclosure.

Referring to FIG. 12, the first door 300 includes a first assembly 320 formed with an opening and a second assembly 330 provided at a lower side of the first assembly 320 and including a plurality of chassis 333 and 334 and a glass 332. In addition, the first door 300 may include a coupling frame 400 arranged between the first assembly 320 and the second assembly 330 so that the first assembly 320 and the second assembly 330 rotate together with each other as a unitary body.

The first assembly 320 may include a first frame 324 that is bent to form a front exterior of the first assembly 320.

The first frame 324 may be formed of a steel plate material. The first frame 324 may be provided in an approximately box shape with one surface open by bending a steel plate. In other words, the first frame 324 may be bent rearward to form an approximately box shape. However, the shape of the first frame 324 is not limited thereto.

The first frame 324 is provided at a front central portion thereof with the opening. The first frame 324 may have an upper end bent portion, a lower end bent portion, and a pair of side bent portions when viewed from the front of the first frame 324.

The first frame 324 may include a door latch 323 on the front thereof. The door latch 323 may be mounted at an inner side of the front of the first frame 324 and exposed to the outside. A second door may include a protrusion for coupling to the door latch 323. The door latch 323 is provided to determine whether to allow rotation the second door.

The first assembly 320 may be provided as an upper assembly.

The second assembly 330 may include a second frame 331, a first chassis 333, a second chassis 334, and a glass 332.

The second frame 331 may be provided to be bent to form one side surface and a part of a front surface of the second assembly 330. The first chassis 333 may be provided to be bent to form the other side surface of the second assembly 330 and protrude forward of the second frame 331. The second chassis 334 may be connected to the second frame 331 and bent to protrude forward of the second frame 331. The glass 332 may be seated between the first chassis 333 and the second chassis 334 to form the front surface of the second assembly 330 that protrudes forward.

The second chassis 334 may include a handle portion formed by a side portion of the second chassis 334 being recessed inward. The user may grip the second chassis 334 from the outside by putting a hand into the handle portion.

Referring to FIG. 13, the coupling frame 400 may include a first support portion 410, a second support portion 420, and a third support portion 430.

The coupling frame 400 may include the first support portion 410 extending along the inner surface of the first assembly 320 so as to come in contact with the lower inner surface of the first assembly 320. The first support portion 410 may be provided to extend upward. The first support portion 410 may be provided in parallel with the inner surface of the first assembly 320.

In detail, the first support portion 410 may be provided to support the first assembly 320. The first support portion 410 may include a front support portion 410*c*, a pair of side support portions 410*b* and 410*d*, and a pair of rear support portions 410*a* and 410*e*. Each of the pair of side support portions 410*b* and 410*d* of the first support portion 410 may be formed with a reinforcing member receiving groove 412. The first support portion 410 may be provided at an upper portion of the coupling frame 400 with respect to an insertion space 411.

The coupling frame 400 may include the insertion space 411 provided below the first support portion 410 and into which the lower end bent portion of the first frame 324 is inserted.

The first support portion 410 may include a hinge coupling portion 413. In detail, the hinge coupling portion 413 may be provided on the front support portion 410*c* of the first support portion 410. A hinge bracket may be coupled to the hinge coupling portion 413 by a fastening member.

The coupling frame 400 may include the second support portion 420 provided in parallel with the inner surface of the second frame 331 so as to come in contact with the upper inner surface of the second frame 331. In detail, the second support portion 420 may be provided to extend downward from one side of the first support portion 410.

The second support portion 420 may include a front support portion 420*a*, a side support portion 420*b*, and a rear support portion 420*c*. The side support portion 420*b* of the second support portion 420 may be formed with the reinforcing member receiving groove 412.

The coupling frame 400 may include the third support portion 430 provided in parallel with the inner surfaces of the first chassis, the second chassis, and the glass so as to come in contact with the upper inner surfaces of the first chassis, the second chassis, and the glass.

The third support portion 430 may include a first chassis support portion 431 and a second chassis support portion 432. The first chassis support portion 431 may include a coupling hook 4311 to be coupled to the first chassis 333. The second chassis support portion 432 may include a coupling hook 4322 to be coupled to the second chassis 334. The second chassis support portion 432 of the third support portion 430 may be formed with the reinforcing member receiving groove 412.

The first support portion 410, the second support portion 420, and the third support portion 430 of the coupling frame 400 may be provided substantially perpendicular to the ground.

The side support portion 410*d* of the first support portion 410 of the coupling frame 400 and the side support portion 420*b* of the second support portion 420 of the coupling frame 400 may form one side surface of the coupling frame 400. In addition, the side support portion 410*b* of the first support portion 410 of the coupling frame 400 and the second chassis support portion 432 of the coupling frame 400 may form the other side surface of the coupling frame 400.

The refrigerator may include a reinforcing member. The reinforcing member may be inserted into the reinforcing member receiving grooves 412 provided on both side surfaces of the coupling frame 400. The reinforcing member receiving groove 412 may be formed by the both side surfaces of the coupling frame 400 being recessed inwardly.

In detail, the reinforcing member receiving groove 412 on the one side surface of the coupling frame 400 may be formed in the side support portion 410*d* of the first support portion 410 and the side support portion 420*b* of the second support portion 420. The reinforcing member receiving groove 412 on the other side of the coupling frame 400 may be formed in the side support portion 410*b* of the first support portion 410 and the second chassis support portion 432.

Referring to FIGS. 13 and 14, the first door 300 may include a cover 490, and the coupling frame 400 may include a cover seating portion 450 that extends from the lower side of the first support portion 410 toward the third support portion 430.

The cover seating portion 450 may include a plurality of air holes 451. Gas generated when the foaming liquid is filled into the door may be discharged through the air hole 451. In addition, the cover 490 covering the cover seating portion 450 may be bonded by the foaming liquid flowing out through the air hole 451.

The cover (490 in FIG. 14) may include at least one hook 491. The at least one hook 491 may be formed to protrude downward from the bottom surface of the cover 490. The cover 490 may include at least one protrusion 492. The at least one protrusion 492 may be formed to extend toward the coupling frame 400 so as to be inserted into the coupling frame 400. In the embodiment shown in FIGS. 12 to 14, five projections 492 are illustrated. However, the number of protrusions 492 may not be limited thereto.

The cover seating portion 450 includes at least one hook coupling groove 452. The at least one hook 491 of the cover 490 may be inserted into the at least one hook coupling groove 452 to enable hook coupling. In addition, the cover seating portion 450 may include at least one protrusion receiving groove 454. The at least one protrusion 492 may be received in the at least one protrusion receiving groove 454.

In addition, the cover seating portion 450 may include hook coupling portions 453 provided on both sides thereof. Hooks 491 provided on both sides of the cover 490 are coupled to the hook coupling portions 453, so that the coupling between the cover 490 and the cover seating portion 450 may be secured.

The cover seating portion 450 of the coupling frame 400 may be exposed to the outside. The first support portion 410, the second support portion 420, and the third support portion 430 of the coupling frame 400 may be provided to be covered by the first assembly 320 and the second assembly 330. However, the cover seating portion 450 may be exposed to the outside due to a shape of the third support portion 430, the first chassis 333, and the second chassis 334 that protrude forward. In order to cover the cover seating portion 450 to enhance the aesthetic appearance, the cover 490 may be coupled and bonded to the cover seating portion 450.

Other components and coupling relationships thereof are the same as those of the first door 100 of the refrigerator according to the above described embodiment of the disclosure.

As is apparent from the above, the door is not manufactured using a single raw material, so that loss of raw materials can be reduced, thereby saving the material cost.

The door is produced by coupling a plurality of structures, so that the exterior can be formed of different materials.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A refrigerator comprising:

a main body including a storage chamber;

a first door rotatably coupled to the main body, and including:

a first assembly forming a front exterior of the first door, and forming an opening in the first door, a second assembly below the first assembly, forming a front exterior of the first door below the front exterior formed by the first assembly, and a coupling frame, being a separate component from the first assembly and being a separate component from the second assembly, the coupling frame disposed between the first assembly and the second assembly and coupled to both the first assembly and the second assembly, wherein the coupling frame includes:

a first support portion in contact with a lower inner surface of the first assembly, a second support portion extending downward from a side of the first support portion and in contact with an upper inner surface of the second assembly, and a third support portion protruding forward of the first support portion and the second support portion and in contact with the second assembly; and a second door rotatably coupled to the main body and the first door to open and close the opening, wherein the storage chamber is accessible through the opening when the first door is closed and the second door is opened.

2. The refrigerator of claim 1, wherein the first assembly includes a first frame bent to form the front exterior of the first door, and the coupling frame includes an insertion space below the first support portion and having a lower end bent portion of the first frame inserted thereinto.

3. The refrigerator of claim 2, wherein the second assembly includes:

a second frame that is bent so as to form one side surface of the second assembly and a part of a front surface of the second assembly, a third frame that is bent so as to form an other side surface of the second assembly and the front surface protruding forward of the second frame, and a handle frame connected to the second frame and the third frame.

4. The refrigerator of claim 1, wherein the coupling frame includes:

a handle support portion between the second support portion and the third support portion.

5. The refrigerator of claim 1, wherein the coupling frame includes a cover seating portion extending from a lower side of the first support portion toward the third support portion and having at least one hook coupling groove.

6. The refrigerator of claim 5, wherein the first door includes a cover configured to cover the cover seating portion and provided with at least one hook protruding downward and inserted into the at least one hook coupling groove.

7. The refrigerator of claim 1, wherein the coupling frame includes a reinforcing member receiving groove formed by a side surface of the coupling frame, and a reinforcing member inserted into the reinforcing member receiving groove.

8. The refrigerator of claim 7, further comprising:

a first fastening member passing through the first assembly, the coupling frame, and the reinforcing member from an upper rear side of the reinforcing member, and a second fastening member passing through the second assembly, the coupling frame, and the reinforcing member from a lower rear side of the reinforcing member.

9. The refrigerator of claim 1, wherein the coupling frame includes a plurality of coupling hooks formed on a rear surface thereof, and the first assembly and the second assembly include at least one hook coupling hole fastened with the plurality of coupling hooks.

10. The refrigerator of claim 1, further comprising:

a hinge bracket coupled to the first assembly and the coupling frame; and a rotation shaft inserted into the hinge bracket and the coupling frame, wherein the second door is coupled to the coupling frame to be rotated on the rotation shaft.

11. The refrigerator of claim 1, wherein the first assembly, the second assembly, and the coupling frame include an iron plate material.

12. The refrigerator of claim 1, further comprising:

a door reinforcing member fixed to insides of the first assembly and the second assembly along edges of the first assembly and the second assembly.

13. The refrigerator of claim 12, wherein the coupling frame includes:

a receiving portion formed at one side of the coupling frame to receive the door reinforcing member, and an elastic portion formed at an other side of the coupling frame and including a material having elasticity to allow the door reinforcing member to be fitted to the coupling frame.

14. The refrigerator of claim 13, wherein the receiving portion extends in a direction from a rear side of the coupling frame to a front side of the coupling frame.

15. A refrigerator comprising:

a main body including a storage chamber;

a first door rotatably coupled to the main body, and including:

a first assembly forming an opening in the first door, a second assembly at a lower side of the first assembly and including a plurality of chassis, glass, and a handle, and a coupling frame, being a separate component from the first assembly and being a separate component from the second assembly, the coupling frame disposed between the first assembly and the second assembly, and including a plurality of coupling hooks coupled to the plurality of chassis, wherein pulling the handle causes the first assembly and the second assembly to rotate together as a unitary body to thereby rotate the first door with respect to the main body, wherein the coupling frame includes:

a first support portion in contact with a lower inner surface of the first assembly, a second support portion extending downward from a side of the first support portion and in contact with an upper inner surface of the second assembly, and a third support portion protruding forward of the first support portion and the second support portion and in contact with the second assembly; and a second door rotatably coupled to the main body and the first door to open and close the opening, and that moves with the first door when the first door is rotated with respect to the main body by pulling the handle, wherein the storage chamber is accessible through the opening when the first door is closed and the second door is opened.

16. The refrigerator of claim 15, wherein the second assembly includes:

a second frame that is bent so as to form one side surface of the second assembly and a part of a front surface of the second assembly;

a first chassis that is bent so as to form an other side surface of the second assembly and to protrude forward of the second frame; and a second chassis connected to the second frame and bent so as to protrude forward of the second frame, wherein the glass is seated between the first chassis and the second chassis to form the front surface of the second assembly that is protruded.

17. The refrigerator of claim 16, wherein the second chassis includes a handle portion formed by the second chassis being recessed inward.

18. A refrigerator comprising:

a main body;

an inner door rotatably coupled to the main body, the inner door including:

a first assembly forming a front exterior of the inner door and having an opening, a second assembly forming a front exterior of the inner door below the front exterior formed by the first assembly, protruding forward of the first assembly, and a coupling frame, being a separate component from the first assembly and being a separate component from the second assembly, the coupling frame disposed between the first assembly and the second assembly, wherein the coupling frame includes:

a first support portion in contact with a lower inner surface of the first assembly, a second support portion extending downward from a side of the first support portion in contact with an inner surface of the second assembly, and a third support portion protruding forward of the first support portion and the second support portion and in contact with the second assembly; and an outer door rotatably coupled to the inner door to open and close the opening.

19. The refrigerator of claim 18, further comprising:

a door reinforcing member seated along an edge of the inner door to reinforce strength of the inner door.

* * * * *